US008151565B2

(12) United States Patent
Carrion-Torres et al.

(10) Patent No.: US 8,151,565 B2
(45) Date of Patent: Apr. 10, 2012

(54) BUOYANCY PRIME MOVER

(76) Inventors: Luis Manuel Carrion-Torres, Rio Grande, PR (US); Carlos Alberto Carrion-Torres, Rio Grande, PR (US)

( * ) Notice: Subject to any disclaimer, the term of this patent is extended or adjusted under 35 U.S.C. 154(b) by 403 days.

(21) Appl. No.: 12/463,159

(22) Filed: May 8, 2009

(65) Prior Publication Data

US 2010/0283260 A1 Nov. 11, 2010

(51) Int. Cl.
*F03B 17/04* (2006.01)

(52) U.S. Cl. ..... 60/465; 60/496; 290/42; 290/43; 290/48

(58) Field of Classification Search ..... 290/42, 290/43, 48, 53–54; 60/495–497, 500–506; 415/92

See application file for complete search history.

(56) References Cited

U.S. PATENT DOCUMENTS

| | | | | |
|---|---|---|---|---|
| 4,385,497 | A * | 5/1983 | Scott | 60/639 |
| 4,865,723 | A * | 9/1989 | De Shon | 210/104 |
| 6,447,243 | B1 * | 9/2002 | Kittle | 415/92 |
| 2010/0146961 | A1 * | 6/2010 | Silva | 60/495 |

* cited by examiner

*Primary Examiner* — Tran Nguyen

(57) ABSTRACT

The invention is directed to the use of buoyancy force as a prime mover that converts the potential energy of a compressed gas transmitted to a buoy device within a liquid into rotating mechanical energy which is mechanically connected to a electric generator, wherein said prime mover comprises a shaft and several extended arms with a buoy device at each distal end to generate the rotational motion at the electric generator.

18 Claims, 11 Drawing Sheets

BUOYANCY PRIME MOVER

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

This invention relates to the use of buoyancy force as a prime mover that converts the potential energy of a compressed gas transmitted to a buoy device within a liquid into rotating mechanical energy comprising a shaft and several extended arms with a buoy device at each distal end to generate the rotational motion at the electric generator.

2. Discussion of the Background

Currently the global warming due to pollution is driving people to use alternative sources of energy such as renewable energy. For example biofuel, biomass, geothermal, hydropower, solar power, tidal power, wave power and wind power. Also buoyancy force had been considered as a prime mover for generators in order to avoid contamination. The main purpose is to use the difference in density between two or more materials which provide a displacement of one of the materials in relation with the other(s). The potential energy generated for the displacement is use to provide enough motion to produce electrical energy when connected to a generator.

U.S. Pat. No. 4,498,294 to Everett discloses a buoyancy prime mover comprising a plurality of rigid or collapsible buckets joined by one or more chains with rotatable sprockets and shafts to form a continuous loop within an enclosure and means for controlling the pressure within the enclosure whereby the buoyant gas is trapped within the buckets, the buckets rise through the liquid and rotate the chain and sprockets to generate power. The use of buoyancy as a prime mover. However, the complex system fails to control efficiently the placing of gas inside the buckets.

U.S. Pat. No. 6,447,243 to Kittle discloses a buoyancy prime mover having a wheel rotating within a housing, wherein said buoyancy prime mover a blower pump operating gas into the buckets. Kittle complex system fails to manage efficiently the placing of gas inside the buckets.

SUMMARY OF THE INVENTION

The present invention overcomes the disadvantages of the Prior Art by providing a prime mover that converts the potential energy of a compressed gas transmitted to a buoy device within a liquid into rotating mechanical energy comprising a shaft and several extended arms with a buoy device at each distal end to generate the rotational motion at the electric generator.

Accordingly, one object of the invention is to manage efficiently the placement of gas inside the buoy device.

Accordingly, one object of the invention is to provide prime mover shaped to reduce friction.

Another object of the invention is to provide an electric generation system that reduces the environmental contamination.

Yet another object of the present invention is to provide a prime mover that use gas for propulsion purposes.

The invention itself, both as to its configuration and its mode of operation will be best understood, and additional objects and advantages thereof will become apparent, by the following detailed description of a preferred embodiment taken in conjunction with the accompanying drawing.

The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The accompanying drawings which are incorporated herein constitute part of the specification and illustrate the preferred embodiment of the invention.

DESCRIPTION OF THE PREFERRED EMBODIMENT

Figure 1:
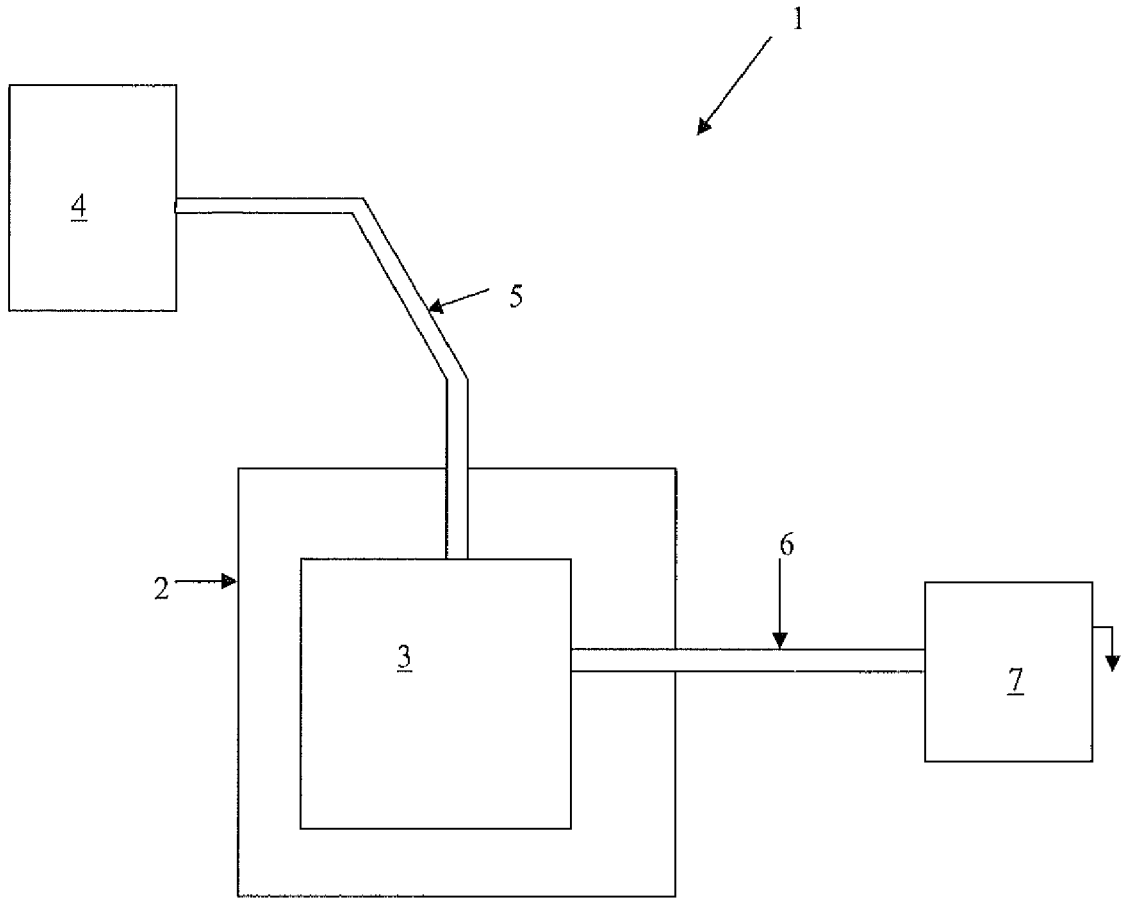
FIG. 1 shows the general structure of the system of present invention.
Figure 2:
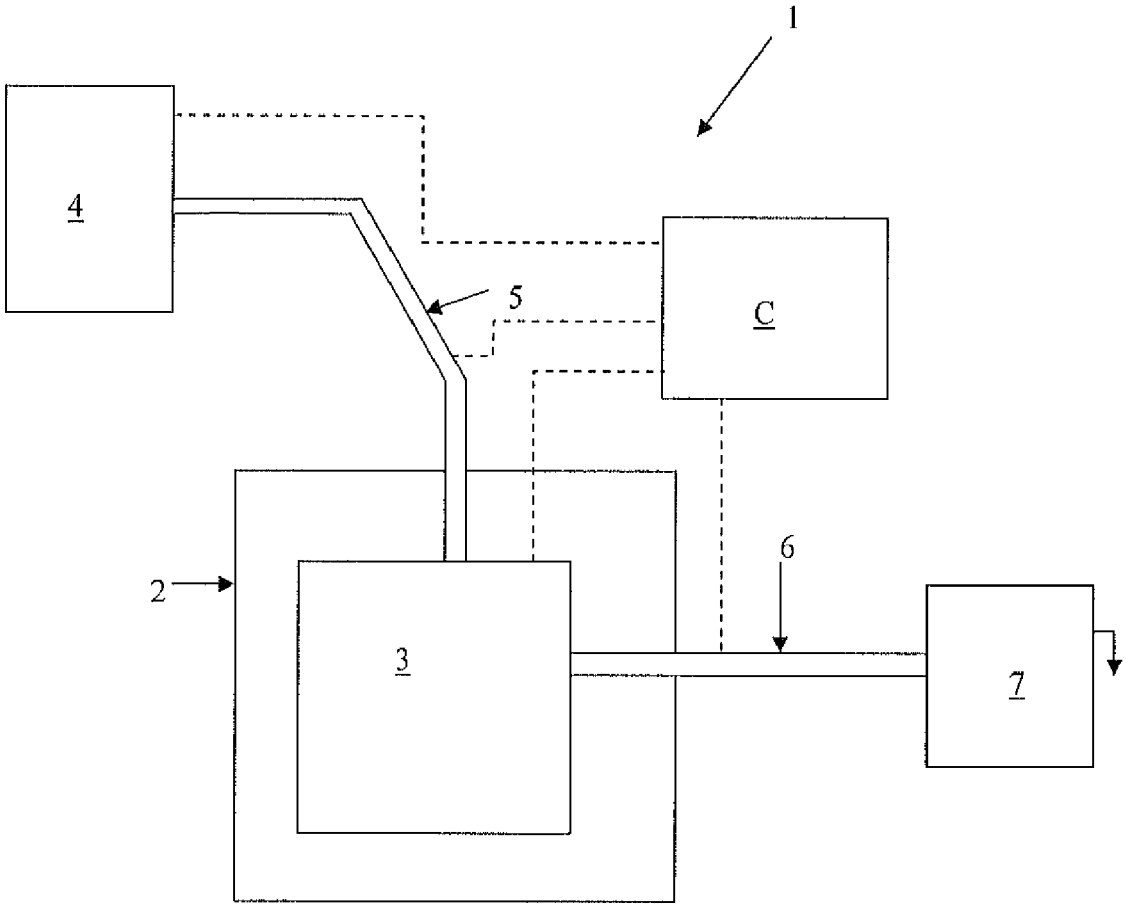
FIG. 2 shows the general structure of the system of present invention with electric control means.

The present invention, as shown in FIG. 1, provides an electric generation system 1 comprising an air supply system 4, a container 2, a prime mover 3, wherein said prime mover 3 is mechanically connected to said air supply system 4 and mechanically coupled to a generator 7. The electric system 1 is monitored using several sensors that generate signals. The sensors are connected to a Control unit C, as shown in FIG. 2 wherein said control unit C comprises a computer or device that manipulates data according to a list of instructions and/or inputs such as said sensor signals. The control unit, depending on the instructions, controls several actions of the system including the air supplied by the air supply system 4 and therefore the rotational speed of the prime mover 3.

Figure 3:
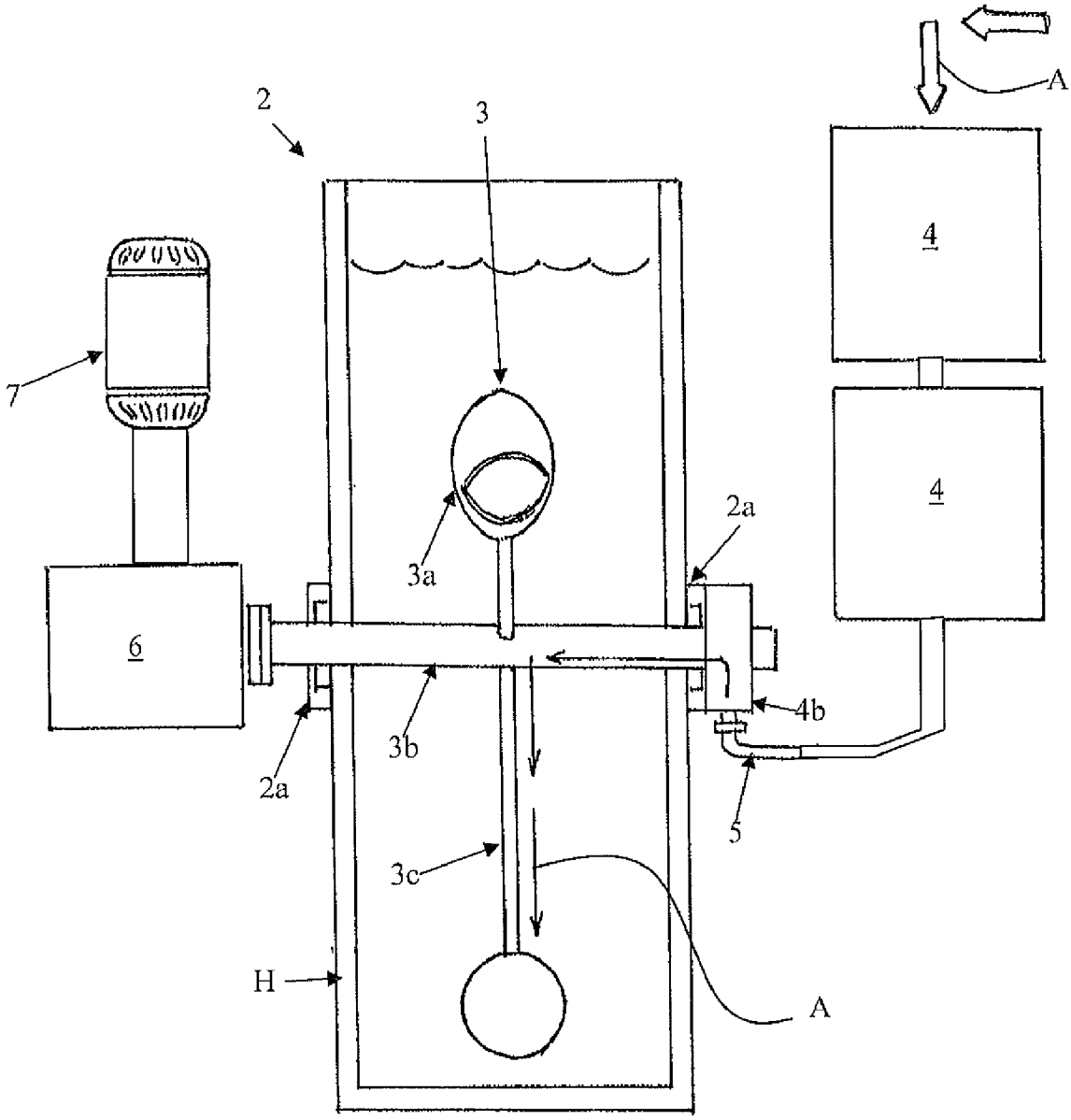
FIG. 3 shows an embodiment of the present invention with a small container.

FIG. 3, shows a first system embodiment of the present invention, wherein the prime mover 3 comprises a shaft 3*b* and several extended arms 3*c* connected to said shaft 3*b* wherein said extended arms 3*c* are connected to a buoy device 3*a* at each distal end. The prime mover is located inside a container 2, wherein said container 2 is filled with fluid having a higher average density than the material/fluid used to fill the buoy device 3*a*. The fluid surrounds more than 80 percent of the prime mover structure. The container 2 also serves as a housing H holding the shaft 3*b* in position and provides bearing features 2*a* substantially at the distal end of the shaft 3*b*. The air supply system 4 is located outside the container but is connected to said prime mover 3 through an air feeder system 4*b* and an air transfer mean, such as a pipe 5. The air A received is guided toward the buoy device 3*a* through internal conduit or channels located at the shaft 3*b*. The shaft is mechanically connected to a generator 7 through mechanical means 6 such as gear. Different types of mechanical connections may be employed in order to transmit the rotational motion provided by the prime mover 4 to said generator 7.

Figure 4:
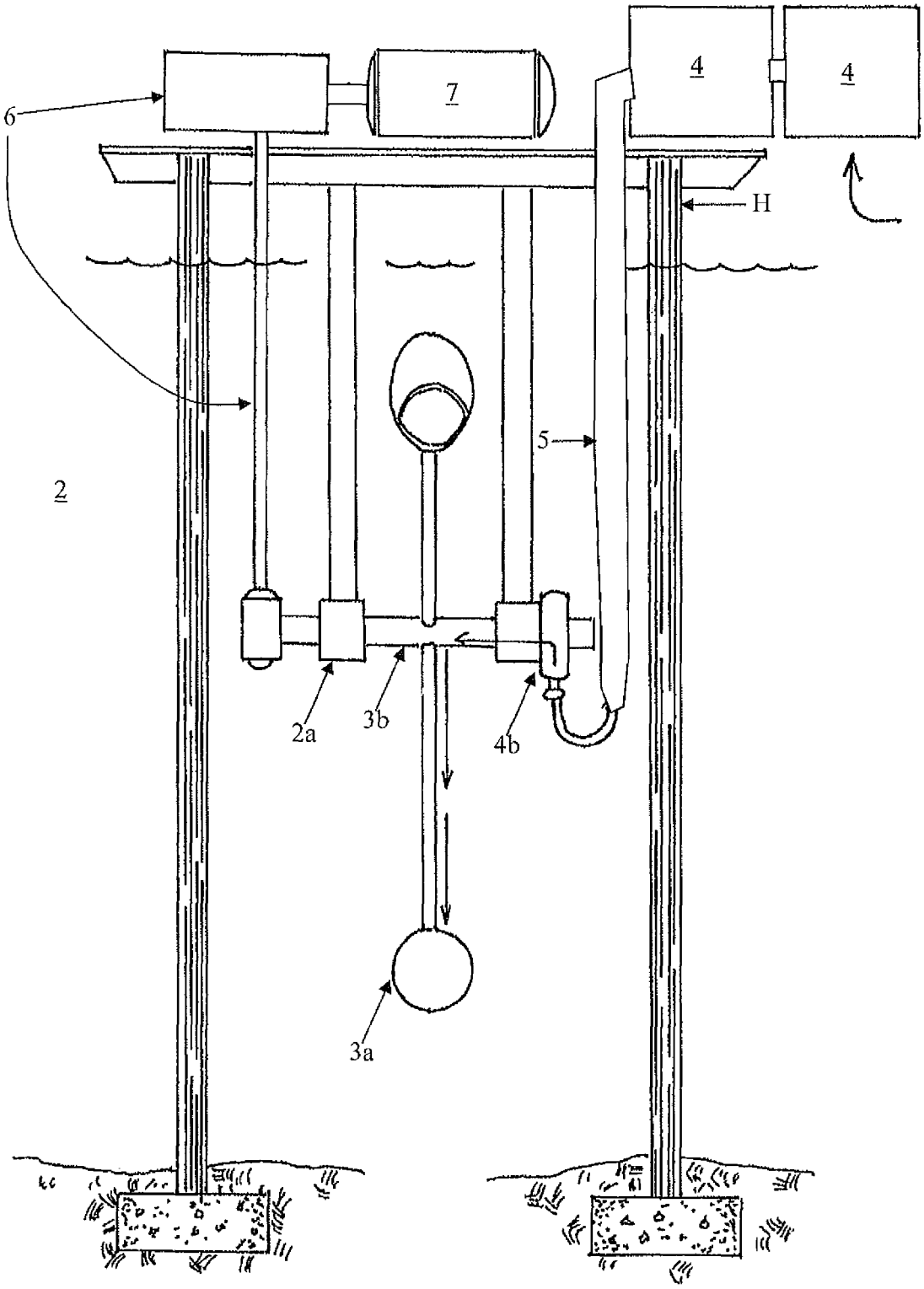
FIG. 4 shows an embodiment of the present invention with a large container.

FIG. 4 discloses a second system embodiment, wherein the elements are designated to perform the same functions as in the first system embodiment. The main difference between the embodiment presented in FIG. 3 and the embodiment presented in FIG. 4 is the size of the container 2. In this instant case the container 2 is bigger than the container 2 presented in the first embodiment. However the container 2 is used to provide support to the prime mover 4 and a platform on top of the prime mover 3 supports the generator 7, the bearings 2*a*, part of the mechanical connection means 6 and the air supply system 4. Also the generator 7 and the air supply system 4 might be located at the shore.

Figure 5:
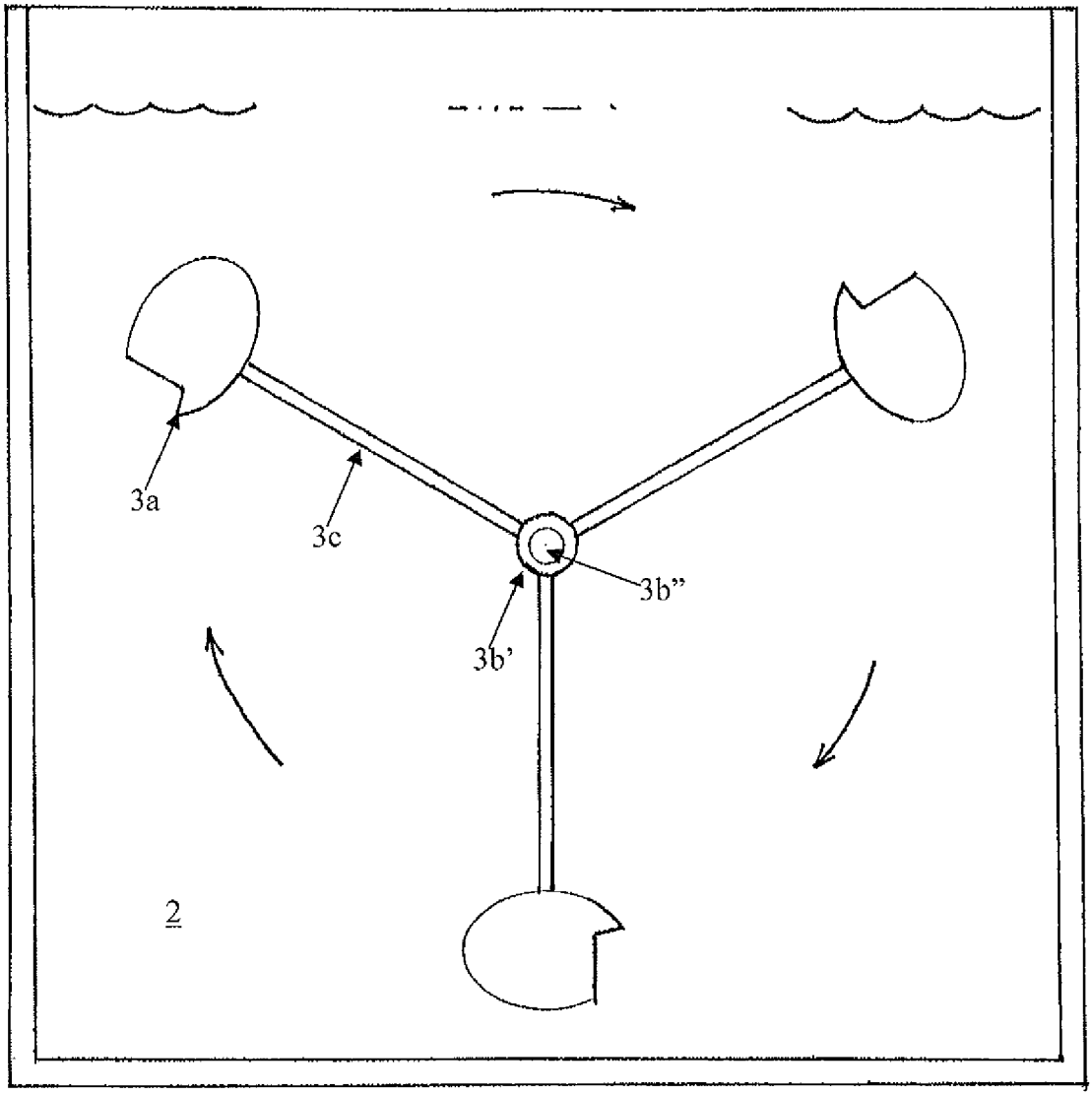
FIG. 5 is a front view of the prime mover.

The prime mover 3, as mentioned before, uses the buoyancy force to generate or provide the rotational motion for the electric generation. FIG. 5 shows the rotational displacement of said prime mover, wherein the extended arms 3*c* are separated by a desired distance. In the instance case the embodiment comprises at least three extended arms 3*c* equally spaced apart arms by 120 degrees. The extended arms 3*c* are connected to the outer rotating shaft 3*b*' at a distal end and the other distal end is coupled to a hollow buoy device 3*a*. The prime mover 3 is arranged to have enough space inside the container 2 so it can move without any undesired contact with the container 2 walls.

Figure 6:
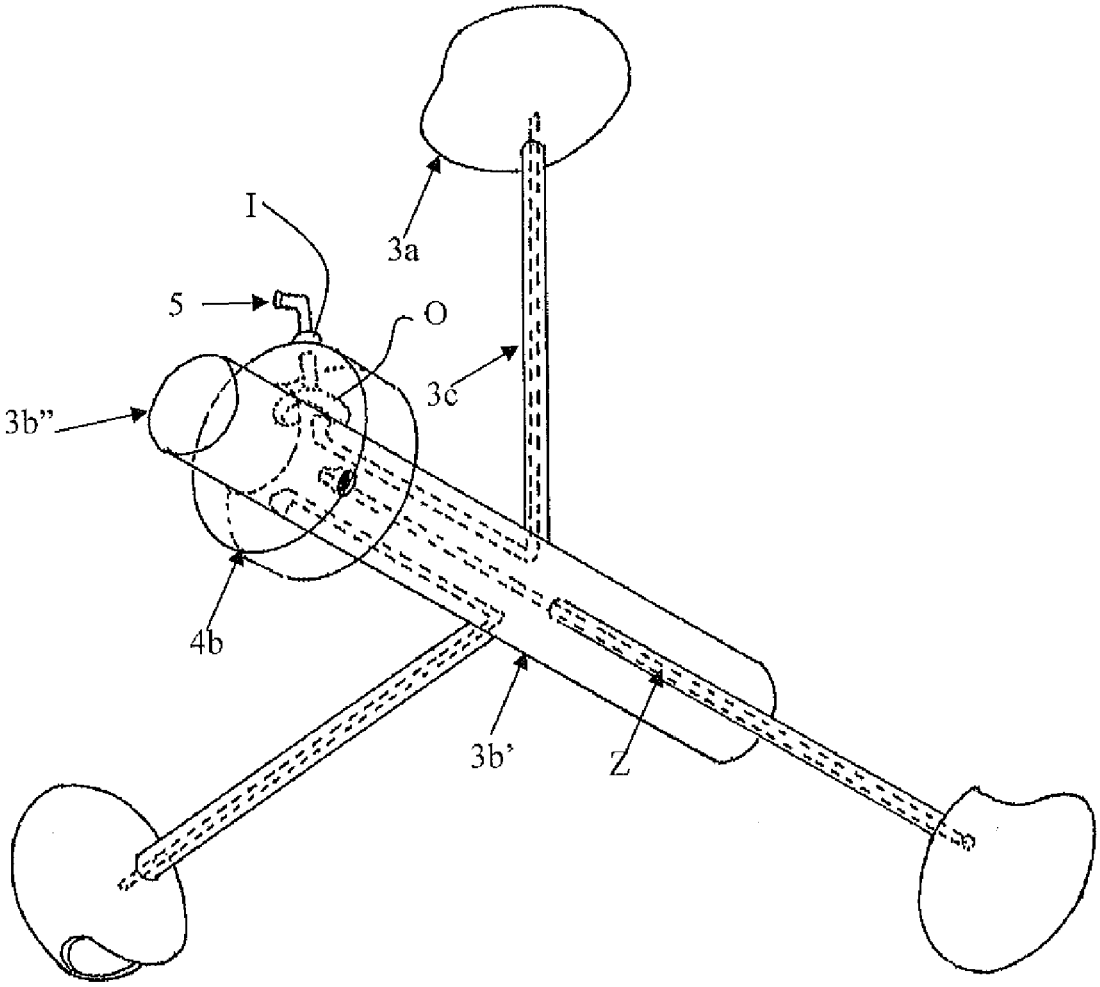
FIG. 6 is an isometric view of the prime mover with a first embodiment of air feeding system.

The prime mover 3 is designed to receive air from the air supply 4 in order to transmit said air to the buoy device 3*a*. Several means may be employed to transfer air to said buoy device 3*a*. For example, FIG. 6 discloses a first embodiment to receive air comprising an air feeder system 4*b* which connects the air transfer means 5 from the air supply system 4 to the shaft 3*b* in order to provide air to said buoy device 3*a*. The air feeder 4*b* is static with respect to the shaft 3*b* and is connected to the outer surface of the shaft 3*b*. The feeder 4*b* comprises an intake I wherein the transfer means 5 is connected to supply air 4 and also is provided with an outtake O section that provides air access to the shaft 3*b* and therefore to the internal channels Z which consequently transfers the air to the buoy device 3*a*. It is important to understand that the outtake O is surrounded with sealing means in order to avoid air supplied by the air transfer means 5 to get away from the outtake O boundaries. Further, each channel Z part that contacts the outtake O is spaced apart by at least 120 degrees.

Figure 7A:
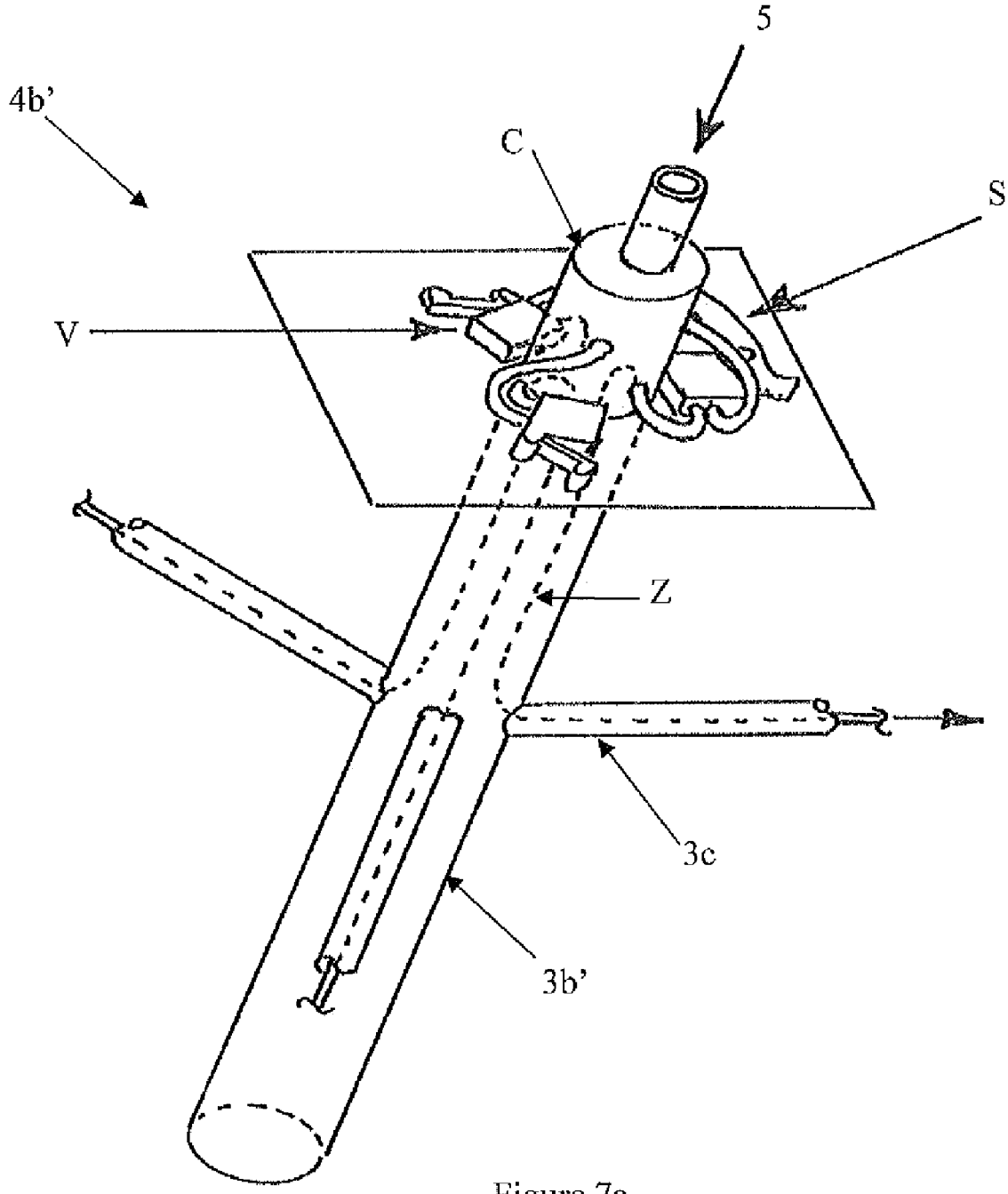
FIG. 7*a*-7*c* shows several views of a second embodiment of an air feeding system.
Figure 7B:
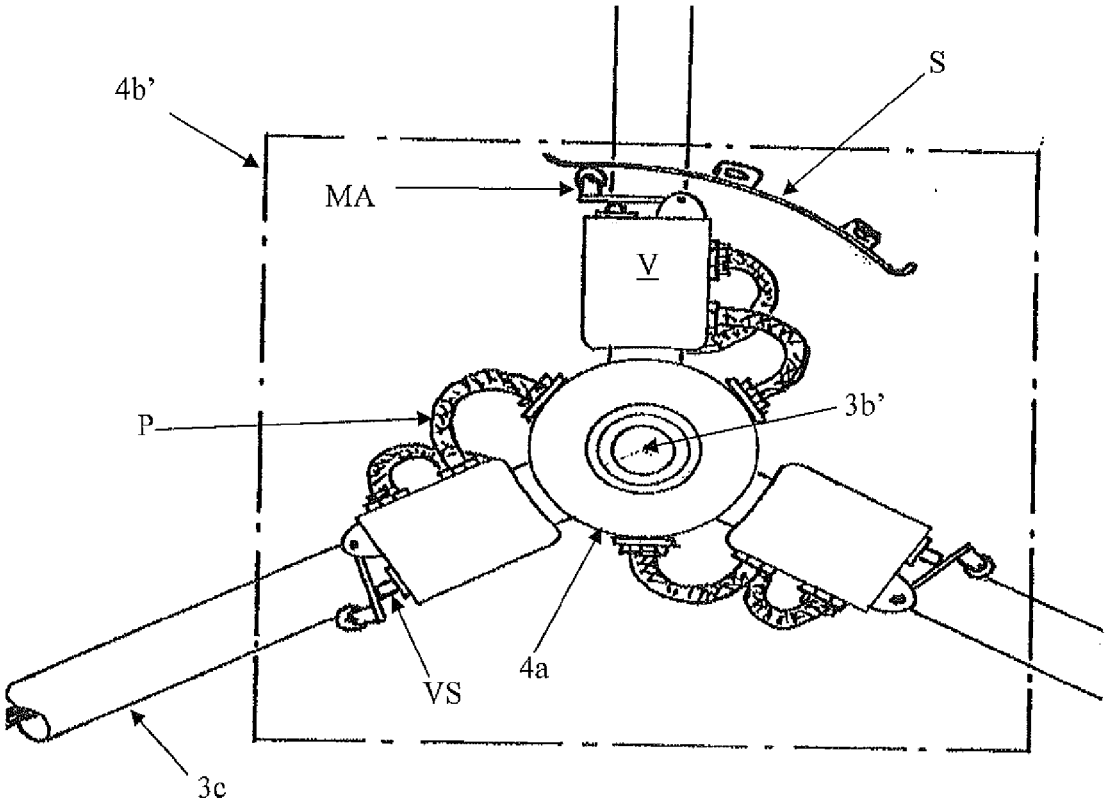
Figure 7C:
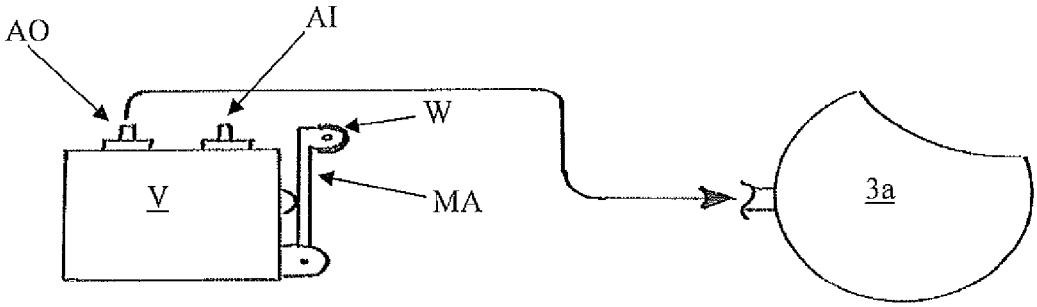

FIG. 7*a*-7*c* discloses a second air feeder embodiment 4*b*'. FIG. 7*a* shows an isometric view of the second air feeder embodiment comprising a shaft 3*b*' having a rotational body at the distal end receiving air from the air transfer means 5 wherein said body provides a chamber C, a valve V mechanically connected to said shaft 3*b*' and arm 3*c*, a switch that mechanically activates said valve V allowing the air flow to said buoy device 3*a* and several pipe connections to transfer air from said shaft 3*b*' to said arms 3*c*. FIG. 7*b* shows at least a valve V for each arm, wherein said valves V are located 120 degrees apart from each other. The valves V rotate with the shaft 3*b*' and the switch control S that mechanically activates the flow of air to the buoy device 3*a* for a desired time. In the instant case while the shaft rotates each valve V is normally close until it reaches the switch control S which mechanically pushes an actuator MA that opens the valve V. The air starts flowing to the buoy device 3*a* for the period of time wherein said time is directed related with the switch control S pressure over the actuator MA, wherein said actuator MA transfer the pressure to a valve switch VS allowing the flow of air. FIG. 7*c* clearly discloses the valve system comprising a valve V, a mechanical actuator MA having a wheel at a distal end, a valve switch VS working as an open/close switch for the air flow, an air input AI connected to the shaft through a pipe P or hose and an output AO which directs the air toward the channel Z inside the arm 3*c*.

Figure 8A:
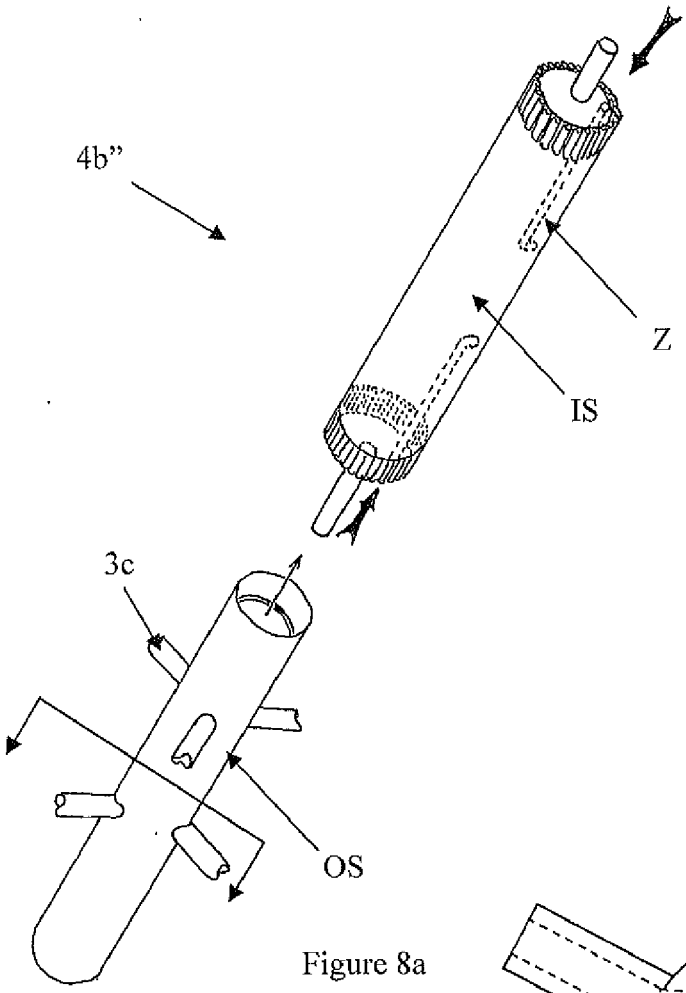
FIG. 8*a*-8*b* shows several views of a third embodiment of an air feeding system.
Figure 8B:
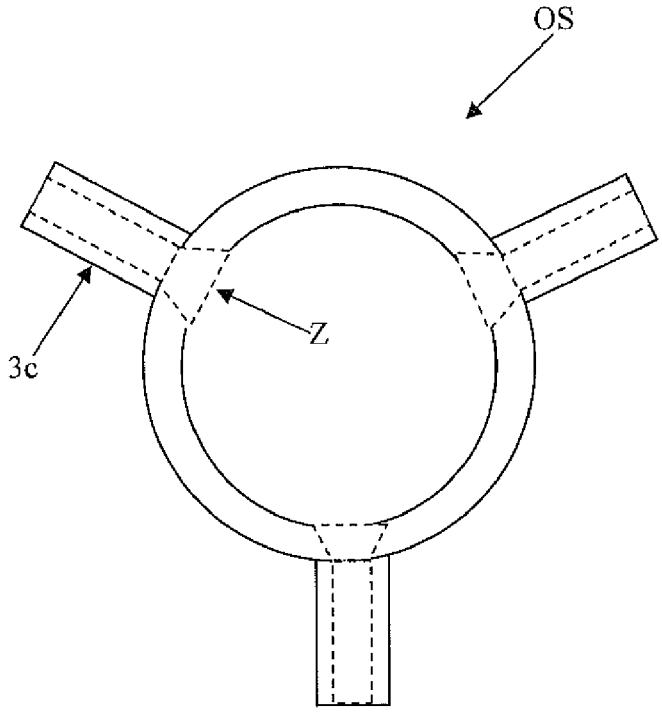

FIG. 8*a*-8*b* discloses a third air feeder embodiment 4*b*", wherein the air feeder is part of the shaft 3*b*, wherein the shaft 3*b* comprises an outer shaft part OS and an inner shaft part IS, wherein said outer shaft OS diameter is bigger than the inner shaft IS and wherein said inner shaft IS portion is located inside said outer shaft OS. The outer shaft OS rotates around the inner shaft IS and both shafts parts are provided with internal channels in order to direct air to the buoy device 3*a* at the extended arms 3*c* distal end. The outer OS channels are shaped to receive air from the IS channels. FIG. 8*b* shows the outer shaft OS channels Z, wherein each outer shaft channel Z contacts the internal channels while the inner shaft IS is static in relation to the shaft. The inner shaft IS has just one internal channel Z providing air to a group extended arms 3*c*. The arrangement reduces the use of several internal channels Z at the inner shaft IS without affecting the displacement or rotational movement of the prime mover 3. Seal means can be used to avoid the air to get away from the outer shaft channel boundaries. It is important to understand that air feeder system 4*b*, 4*b*', 4*b*" may provide air for a section or groups comprising three arms 3*c* per group. However multiple groups can be connected to a single shaft and/or air feeder system as shown in FIG. 8*a*.

Figure 9A:
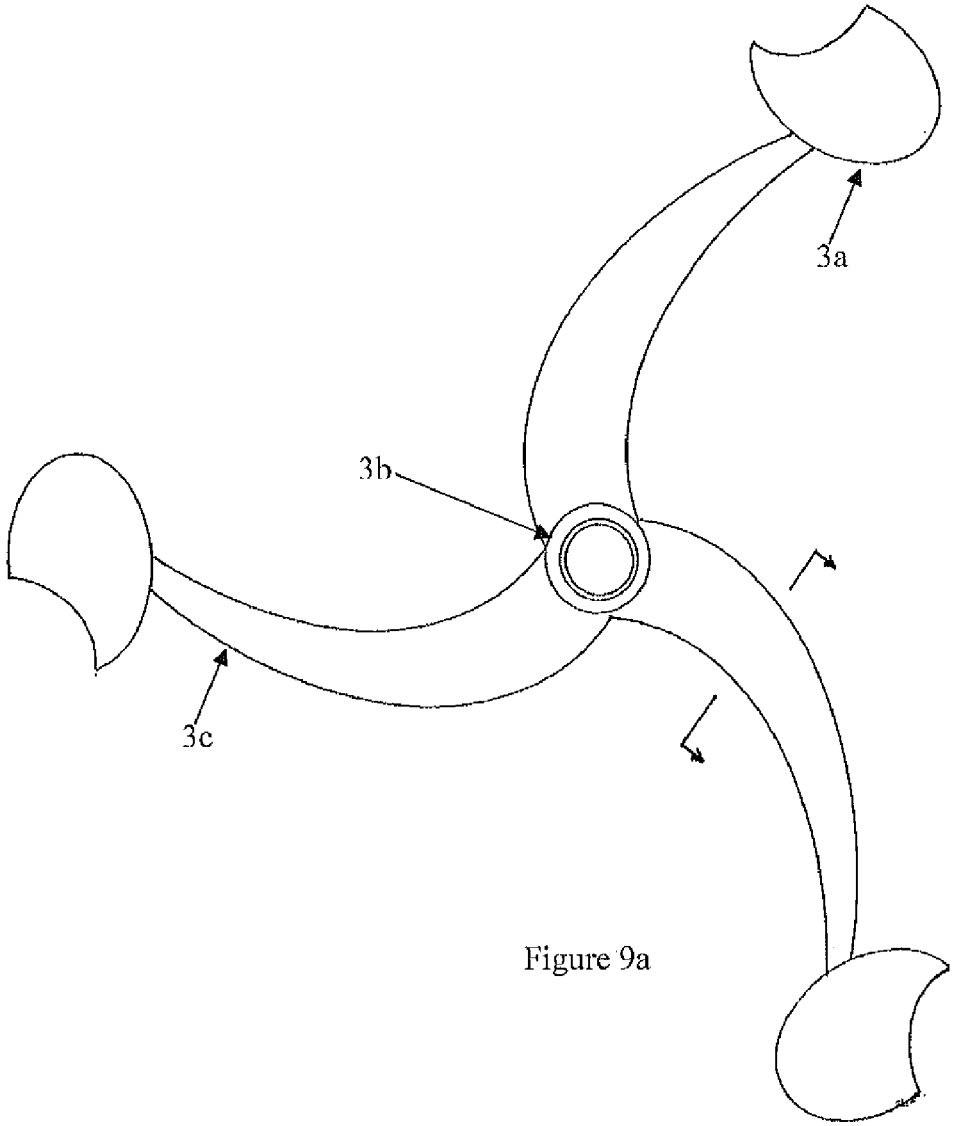
FIG. 9*a*-9*b* is side view of the prime mover with shaped arms.
Figure 9B:
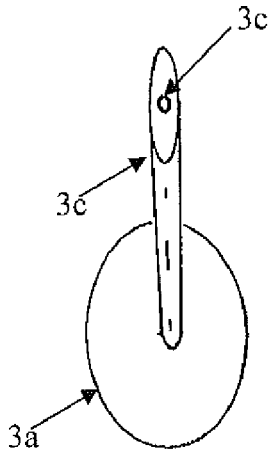

As mentioned before, each extended arm 3*c* has an internal channel Z that direct air to the buoy device 3*a* at the distal end. The body of the extended arm 3*c* and buoy 3*a* are shaped to provide a contour which reduces the friction between the extended arm and the fluid surrounding said extended arm 3*c*. FIGS. 9*a*-9*b* shows an extended arm having an elliptical contour. Further the extended arm 3*c* and buoy 3*a* may comprise fins for keeping the buoy moving forward in a controlled manner.

Figure 10A:
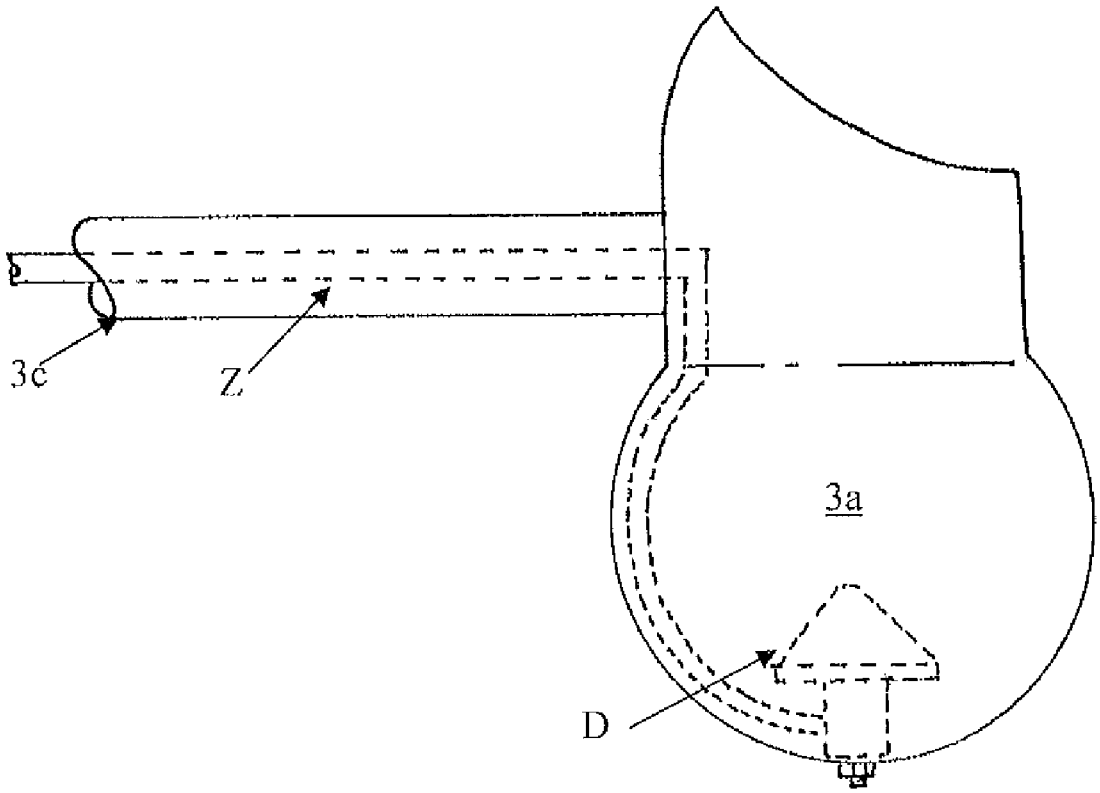
FIG. 10*a* shows a buoy device and internal channel with an air diffuser.
Figure 10B:
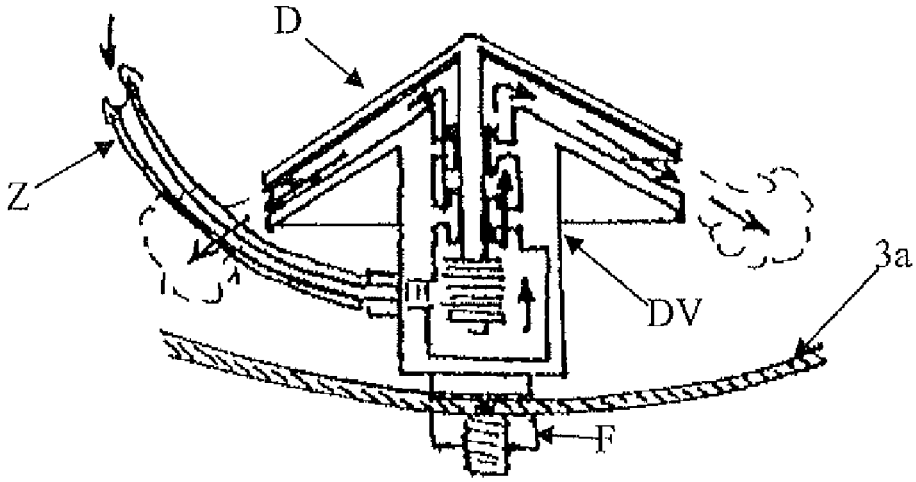
FIG. 10*b* shows the air diffuser.

The buoy device 3*a* located at the extended arm distal end, as shown in FIG. 10*a* and FIG. 10*b*, comprises a hollow container body having an opening and a bottom surface, wherein said hollow body is prepared to withstand gas or a material with less density that the material inside the container while forcing the displacement of the extended arm due to the buoyancy principle. The hollow body holds the material at the hollow area until reaching a preset point and then releases the gas. As mentioned before the hollow body is shaped to facilitate or reduce the friction during displacement of the buoy device 3*a*.

The gas is delivered, as mentioned before, through a channel Z that transfers the air from the air supply system 4 to the buoy device 3*a*. The hollow body includes a portion of said channel Z in such way that the gas is delivered inside said buoy device 3*a*. Several means may be used to deliver gas at the buoy device 3*a*. In the instant case the gas is delivered by a diffuser D which is attached by fastening means F, such as screws, to the bottom of said hollow body. The diffuser D comprises a valve DV that controls the amount of air transfer to said hollow body. The valve DV only allows the flow of air in one direction and prohibits the flow of external fluid inside the internal channel Z. Also the diffuser D allows the use of said gas as propulsion means in order to assist the shaft's 3*b* rotational movement.

While the invention has been described as having a preferred design, it is understood that many changes, modifications, variations and other uses and applications of the subject invention will, however, become apparent to those skilled in the art without materially departing from the novel teachings and advantages of this invention after considering this specifications together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. An electric generation system comprising:

a first material supply system for supplying a first gaseous material having a first density, a container holding a second fluid material having a second density, wherein the second density differs from the first material density, a housing, at least one generator, a coupling mechanism for transmitting torque and rotation, a prime mover, wherein said first material supply system is mechanically connected to said prime mover, wherein said coupling mechanism couples said prime mover to said generator, wherein said housing restrains said prime mover displacement, wherein said prime mover is substantially inside said container and comprises;

a shaft, a plurality of extended arm, wherein said extended arms are connected to said shaft at a distal end and to a buoy device at the other distal and wherein said extended arms, shaft and buoy device comprises several guiding means for transferring said first gaseous material from the shaft to the buoy device; and wherein a first material feeder controls the first gaseous material supplied to said prime mover.

2. An electric generation system as in claim 1, wherein said buoy device comprises a hollow body with at least an opening for releasing said first gaseous material and delivering means to control the release of the first material inside the hollow body.

3. An electric generation system as in claim 2, wherein said delivering means is a diffuser attached to the buoy device body and connected to said buoy device guiding means, wherein said diffuser comprises a one-way valve controlling the flow of the first gaseous material toward the hollow body.

4. An electric generation system as in claim 1, wherein said first material feeder is connected between the shaft and the first material supply system.

5. An electric generation system as in claim 1 wherein said guiding means are internal conduits.

6. An electric generation system as in claim 1 wherein said extended arms are gathered to form at least a group, wherein said extended arms are radially spaced apart from each other.

7. An electric generation system as in claim 1, wherein said first material feeder comprises;

a body, wherein said body is static with respect to the shaft, wherein said static body comprises an intake connected to the first material supply system through transfer means and an outtake providing first gaseous material access to the shaft guiding means connected to the outer surface of the shaft, wherein said shaft has a guiding mean connecting each extended arm and each shaft guiding means are radially spaced apart; and sealing means to avoid the first gaseous material to get away from the outtake boundaries.

8. An electric generation system as in claim 1, wherein said first material feeder comprises;

a rotational body connected to a distal end of the shaft for receiving the first gaseous material from the first material supply system through a transfer means, wherein said rotational body creates a chamber containing the first gaseous material, at least a valve mechanically connected to each guiding mean of said shaft, wherein each valve controls the flow of the first gaseous material from the chamber to each shaft guiding mean and is radially spaced apart, wherein each shaft guiding mean connects a particular extended arm; and a switch that mechanically activates said valve allowing the first gaseous material to flow from the chamber to a selective shaft guiding mean.

9. An electric generation system as in claim 1, wherein said first material feeder is integrally made with the shaft and comprises;

an inner shaft, wherein said inner shaft includes at least a guiding mean and an intake for receiving the first gaseous material from the first material supply system though a transfer means, wherein said inner shaft guiding mean is positioned to transfer the first gaseous material to an outer shaft guiding mean at a preselected position; and wherein said outer shaft comprises several guiding means radially spaced apart wherein each outer shaft guiding mean connects a particular extended arm.

10. An electric generation system as in claim 1, wherein said buoy device and extended arms are shaped to reduce the friction with said second fluid material.

11. A prime mover comprising;

a shaft, several extended arms, wherein said extended arms are connected to said shaft at a distal end and to a buoy device at the other distaled, wherein said buoy device comprises a hollow body with at least an opening and delivering means to control the flow of a fluid residing inside the hollow body; and wherein said extended arms, shaft and buoy device comprise several guiding means, wherein said guiding means are extended from the shaft to the buoy device.

12. A prime mover as in claim 11, wherein said delivering means is a diffuser attached to the buoy device body and connected to said buoy device guiding means, wherein said diffuser comprises an one way valve controlling the flow of said fluid toward the hollow body.

13. A prime mover as in claim 11 wherein said guiding means are internal conduits.

14. A prime mover as in claim 11 wherein said extended arms are gathered to form at least a group, wherein said extended arms are radially spaced apart from each other.

15. A prime mover as in claim 11, wherein said shaft comprises a feeder connected to the shaft guiding mean.

16. A prime mover as in claim 15, wherein feeder comprises;

a body, wherein said body is static with respect to the shaft, wherein said static body comprises an intake and an outtake connected to the outer surface of the shaft providing access to the shaft guiding means, wherein said shaft has a guiding mean connecting each extended arm and each shaft guiding means are radially spaced apart;

and sealing means around outtake boundaries.

17. A prime mover as in claim 11, wherein said feeder comprises;

a rotational body connected to a distal end of the shaft, wherein said rotational body creates a chamber, at least a valve mechanically connected to each guiding mean of said shaft, wherein each valve controls the flow of a fluid from the chamber to each shaft guiding mean and is radially spaced apart, wherein each shaft guiding mean connects a particular extended arm; and a switch that mechanically activates said valve allowing the flow of said fluid from the chamber to a selected shaft guiding mean.

18. A prime mover as in claim 11, wherein said feeder is integrally made with the shaft and comprises;

an inner shaft, wherein said inner shaft includes at least a guiding mean and an intake, wherein said inner shaft guiding mean is positioned at a preselected position to create a continuous path with an outer shaft guiding mean; and wherein said outer shaft comprises several guiding means radially spaced apart wherein each outer shaft guiding mean connects a particular extended arm.

* * * * *